United States Patent [19]

Donnelly

[11] 4,287,991

[45] Sep. 8, 1981

[54] MODULARIZED UNIT LOAD AND DISPOSABLE PALLET THEREFOR

[76] Inventor: Bernard P. Donnelly, 1306 Waukazoo Dr., Holland, Mich. 49423

[21] Appl. No.: 26,002

[22] Filed: Apr. 2, 1979

[51] Int. Cl.[3] ..... B65D 19/00

[52] U.S. Cl. ..... 206/597; 206/600; 108/56.1

[58] Field of Search ..... 206/386, 597, 598, 599, 206/600; 108/51.1, 55.1, 55.5, 56.1, 56.2

[56] References Cited

U.S. PATENT DOCUMENTS

| | | | |
|---|---|---|---|
| 2,894,671 | 7/1959 | Nicholls | 206/386 |
| 3,650,224 | 3/1972 | Petix et al. | 108/51.1 |
| 3,659,707 | 5/1972 | Nilsson et al. | 206/386 |
| 3,677,201 | 7/1972 | Chadbourne | 108/51.1 |
| 4,100,859 | 7/1978 | Clark, Jr. | 206/600 |

FOREIGN PATENT DOCUMENTS

| | | | |
|---|---|---|---|
| 254774 | 6/1967 | Austria | 206/597 |
| 2311717 | 12/1976 | Fed. Rep. of Germany | 206/597 |
| 2388725 | 12/1978 | Fed. Rep. of Germany | 206/600 |
| 7707807 | 1/1978 | Netherlands . | |

*Primary Examiner*—Joseph Man-Fu Moy

*Attorney, Agent, or Firm*—Price, Heneveld, Huizenga & Cooper

[57] ABSTRACT

A unit load of rectangular objects is provided including a plurality of breakaway modules. Each breakaway module comprises a parallel array of objects stacked in side-by-side relationship in successive layers. The breakaway modules are stacked in end-to-end relationship to form the unit load. A plurality of severable longitudinally extending angled corner braces interconnect the modules. A plurality of tension bands are provided, each tension band surrounding the corner braces and a single parallel array of objects to secure each parallel array of objects in modular form. A pull sheet may be provided for selectively longitudinally interconnecting the modules or a disposable pallet may be provided, the pallet being frangible between modules to facilitate breakaway of each module.

23 Claims, 10 Drawing Figures

MODULARIZED UNIT LOAD AND DISPOSABLE PALLET THEREFOR

BACKGROUND OF THE INVENTION

The present invention relates generally to palletized loads and pallets therefor, and in particular relates to a modularized unit load and pallet therefor.

Palletized loads of rectangular objects are common in the prior art. Generally, these palletized loads comprise a plurality of rectangular objects stacked in horizontally spaced tiers atop a pallet to form a rectangular unit load. The rectangular objects are stacked in interleaved fashion much like a mason would lay a brick wall. Stacking of the objects in an interleaved fashion serves to strengthen the unitized load. Tension bands in some cases may encompass the unitized load as well as a portion of the pallet. Such a unitized load is easily transferred with a forklift by inserting the tines of the forklift into the apertured pallet. However, with any of the prior art palletized loads once the unit load is broken to remove even one or two of the rectangular objects or packages, the structural integrity of the unit load is destroyed. The objects of the unit load then become difficult to move from one place to another and with the unit load broken, the possibility of pilferage, or loss of cartons due to cartons falling off of the pallet, is quite high.

SUMMARY OF THE INVENTION

These and other problems in the prior art are solved by provision of a modularized unit load of rectangular objects. A plurality of breakaway modules of the objects are provided, each breakaway module comprising a parallel array of objects stacked in side-by-side relationship. The breakaway modules are stacked in end-to-end relationship to form a rectangular unit load. The modules are interconnected by a plurality of severable longitudinally extending braces. A plurality of vertical tension bands surround the braces, each tension band surrounding a single parallel array of objects to secure each of the parallel array of objects in modular form. Modules of the objects may be selectively removed from the unit load by severing the longitudinally extending braces and breaking away one or more modules. The effect of this arrangement is a modularized unit load which is completely integrated and which can be transported by a forklift, clamp-type lift, or the like. However, the load can be broken into modules by severing the longitudinally extending braces and removing one or more modules. The modules thus separated from the unit load are still securely tied together in a parallel array which may be easily transported by hand truck to a different location. Yet, the portion of the unit load that remains is still securely bound in a manner that allows further movement by a forklift, or the like, without concern for pilferage or loss of objects from the load.

In more narrow aspects of the invention, the modularized load further includes means for selectively longitudinally interconnecting the modules comprising either a longitudinally extending pull sheet or a frangible disposable pallet longitudinally interconnecting the modules. In either case, the tension bands encompass the pull sheet or the frangible pallet. In the case of a pull sheet, once the longitudinally extending braces are severed, the sheet is pulled from between one or more of the parallel array of articles in the unit load to release one or more modules from the unit load. In the case of the frangible pallet, modules are removed by severing the longitudinally extending braces and then applying sufficient force to the modules to break the pallet between modules. In the case of the frangible pallet, one or more modules may be broken from the unit load without separation of the modules to further facilitate handling of the objects broken away from the unit load.

DESCRIPTION OF THE PREFERRED EMBODIMENTS

Figure 1:
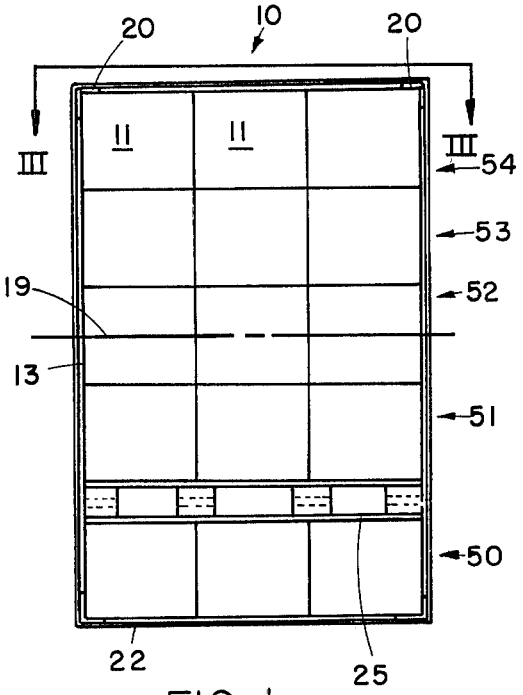
FIG. 1 is a side elevational view of a modularized unit load and pallet therefor constructed according to the present invention.
Figure 3:
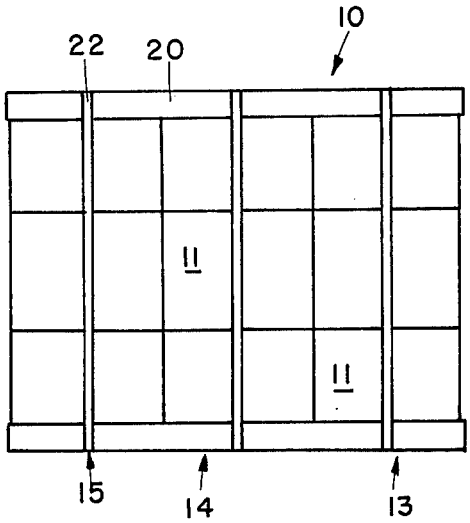
FIG. 3 is a top view of the modularized unit load of FIG. 1 taken along the line III—III in FIG. 1.
Figure 2:
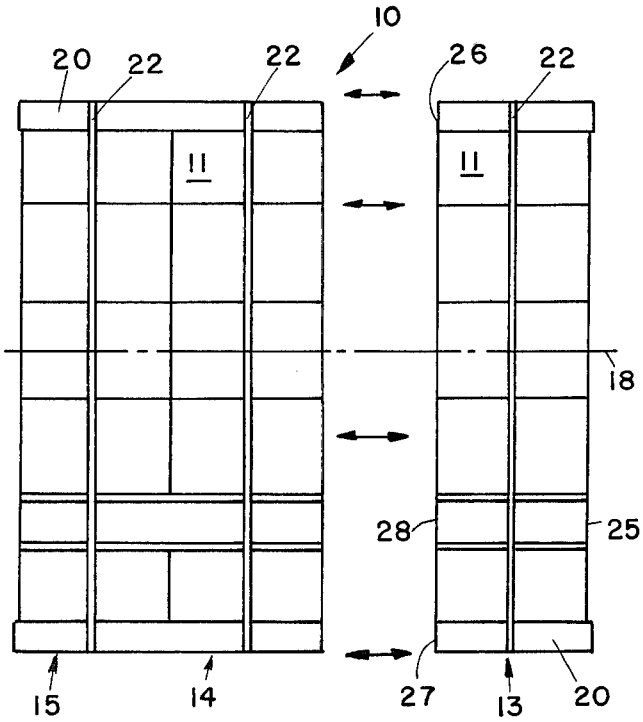
FIG. 2 is a side elevational view of a modularized unit load and pallet therefor showing one module broken away from the unit load.

Referring to FIGS. 1, 2 and 3, a modularized unit load 10 of rectangular objects 11 is illustrated. The unit load 10 is comprised of a plurality of breakaway modules 13, 14 and 15 as best illustrated in FIG. 2. Each of the breakaway modules, such as the module 13, comprises a parallel array of objects 11, the objects 11 being stacked in side-by-side relationship. For purposes of reference, the line 18 in FIG. 2 defines the longitudinal direction and the line 19 in FIG. 1 defines the transverse direction. Each of the modules such as the module 13 comprise a parallel array of objects centered in a transversely extending plane. The breakaway modules 13, 14 and 15 are aligned in end-to-end relationship. Each of the rectangular breakaway modules is centered on a longitudinally extending axis to form a rectangular unit load. A plurality of severable longitudinally extending angled corner braces 20 are provided for longitudinally interconnecting the modules 13, 14 and 15. A plurality of tension bands 22 encompass both the corner braces 20 and the objects 11. Each tension band 22 surrounds a single parallel array of objects 11 to secure each of the parallel arrays of objects 11 in modular form as illustrated by the module 13 separated from the unit load 10 in FIG. 2. In this case, the unit load 10 is provided with means for selectively longitudinally interconnecting the modules comprising a frangible pallet 25. To remove a module from the unit load 10, as illustrated in FIG. 2, the longitudinally extending corner braces 20 are severed at 26 and 27 and sufficient force is applied to the module 13 to separate frangible pallet 25 at 28. The module 13 still bound together in rectangular form by tension band 22 and corner braces 20 may then be transported from one location to another by hand truck or the like. The remainder of the unit load 10 (in this case comprising modules 14 and 15) still forms an integral package that may be transported by forklift, or the like, from one location to another without concern for pilferage, or loss of one or more of the objects 11 from the travelling forklift.

Figure 4:
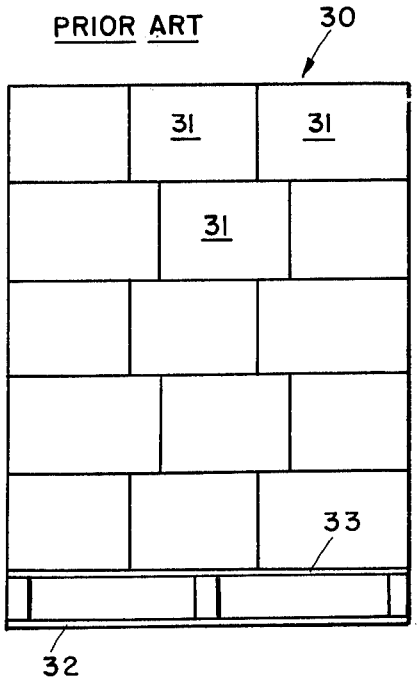
FIG. 4 is a side elevational view of a prior art unit load and pallet therefor.

Referring to FIG. 4, the modularized unit load of the present invention is contrasted to a typical prior art unit load 30. In the case of the prior art unit load 30, a plurality of rectangular objects 31 are stacked in interleaved fashion to form a rectangular unit load which is palletized on a conventional pallet 32. Sometimes, the prior art unit load 30 is bound into an integral package by a frame or cap and the use of tension bands, not illustrated in FIG. 3. Typically, the tension bands extend either in a transverse or longitudinal direction, often encompassing only the top portion 33 of the pallet 32 for the purpose of securing the same thereto. Once one or more of the tension bands are release for removal of some of the objects 31 from the unit load 30, the structural stability of the unit load 30 is substantially impaired. This often leads to pilferage of the articles 31 from the unit load 30 or loss of one or more of the articles due to the unstable nature of the load 30 during transit with a forklift. Furthermore, the objects 31 removed from the unit load 30 are no longer bound together and must either be hand carried to their respective destinations or vertically stacked on a hand truck for transit. Even when a hand truck is used the articles 31 must be moved from the pallet load one by one so they can be transported.

Figure 5:
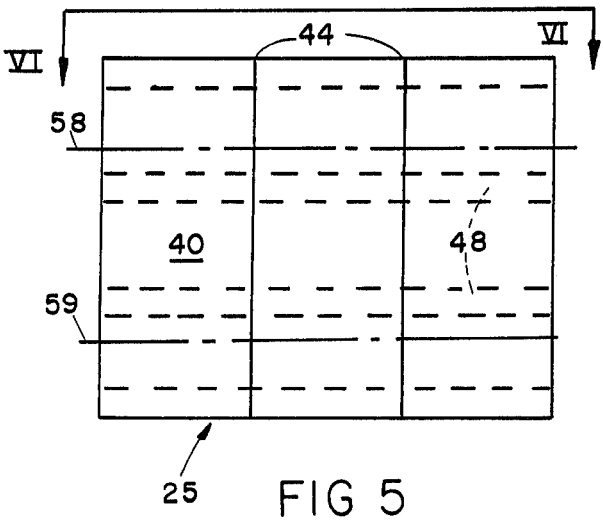
FIG. 5 is a top plan view of a frangible pallet constructed according to the present invention.
Figure 6:
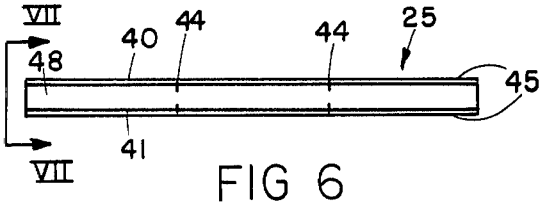
FIG. 6 is a front elevational view of the frangible pallet of FIG. 5 taken along lines VI—VI of FIG. 5.
Figure 7:
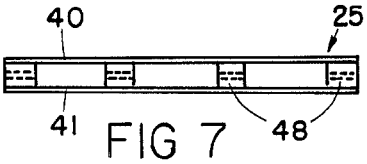
FIG. 7 is a side elevational view of the frangible pallet of FIG. 6 taken along line VII—VII of FIG. 6.

Referring now to FIGS. 5, 6 and 7 the disposable frangible pallet 25 of the present invention is illustrated in further detail. The pallet 25 comprises top and bottom layers of sheet material 40 and 41, respectively, having a length and width equal to the length and width of the unit load 10. The top and bottom layers 40 and 41 are divided transversely between modules at 44 into a plurality of separate transversely extending strips of sheet material. Pairs of the strips of sheet material such as the pair of strips 45 are associated with a single breakaway module. A plurality of longitudinally extending frangible stringers 48 are secured to the top and bottom sheets 40 and 41, respectively. The longitudinally extending stringers 48 define one or more longitudinally extending apertures for the insertion of the tines of a forklift, for example along longitudinally extending axes 58 and 59, to facilitate handling of the unit load. As best illustrated in FIGS. 6 and 7, the stringers 48 are partially cut through transversely between the modules at 44 to facilitate breakaway of each module. Referring briefly back to FIG. 7, it is illustrated that the unit load 10 can be divided into a plurality of horizontally extending tiers 50 through 54. Preferably, the frangible pallet 25 is disposed within the unit load 10 above the lowermost horizontally extending tier 50.

Figure 8:
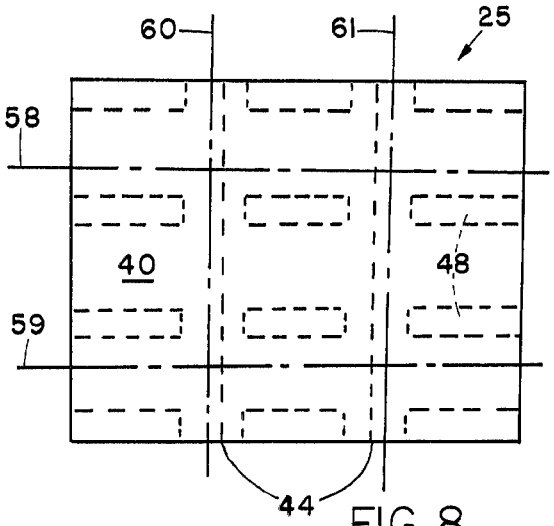
FIG. 8 is a top plan view of another embodiment of the frangible pallet of the present invention.

Referring now to FIG. 8, an alternate embodiment of the frangible pallet 25 is illustrated. In the embodiment of the frangible pallet illustrated in FIG. 8, the longitudinally extending stringers 48 are discontinuous along transversely extending axes 60 and 61 to provide for the insertion of the tines of a forklift from the transverse as well as the longitudinal direction. In this case, since the longitudinally extending stretchers 48 are provided with discontinuities disposed between adjacent breakaway modules of the unit load 10, the top and bottom sheets are provided with perforations disposed between modules at 44. The perforated areas of the top and bottom sheets at 44 serve to longitudinally interconnect adjacent modules while still providing for the breakaway of each module when sufficient force is applied to the module to sever the top and bottom layers along one of the perforated interfaces at 44.

The top and bottom layers 40 and 41 preferably are made of a double-faced corrugated paper or cardboard material. The longitudinally extending stringers 48 may be manufactured from a variety of paper materials, or plastic materials such as a closed cell polyurethane foam. Preferably, the stringers 48 and the top and bottom sheets 40 and 41 are glued together. These components may be preassembled by a pallet manufacturer or shipped in kit form to the user to be cut, slit and glued together at the user's plant. In the latter case, the bulk of the pallet material would be greatly reduced for shipping and the user would be given greater latitude in the use of the inventory of palletizing materials.

Figure 9:
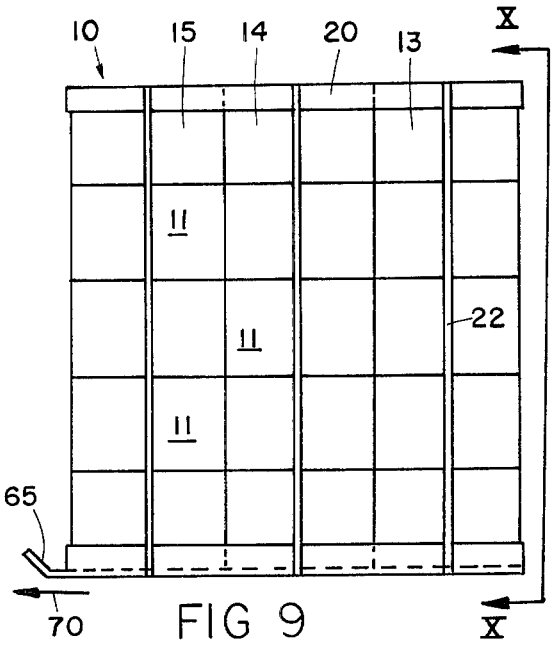
FIG. 9 is a front elevational view of another embodiment of a modularized unit load constructed according to the present invention.
Figure 10:
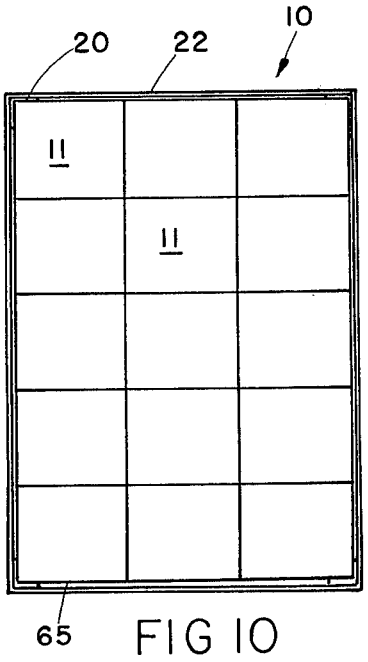
FIG. 10 is side elevational view of the modularized unit load of FIG. 9 taken line X—X of FIG. 9.

Referring now to FIGS. 9 and 10 in another embodiment of the invention specifically designed for use with a clamp-type lift as opposed to a forklift, the unit load 10 is provided with means for selectively longitudinally interconnecting the modules 13, 14 and 15 comprising a longitudinally extending pull sheet 65. The longitudinally extending pull sheet 65 is encompassed by the tension bands 22 to insure the longitudinal structural integrity of the unit load 10. However, once the corner braces 20 are severed between one or more of the modules, the modules may be selectively released from the unit load 10 by drawing sheet 65 longitudinally in the direction of arrow 70 out of the unit load 10. The pull sheet 65 may be of a double-faced corrugated material or may be formed of a suitable polymeric material. Likewise, the corner braces 20 may be formed from suitable paper or polymeric materials. The tension bands 22 may be formed from polymeric or metal materials depending on the weight and size of the unit load.

The above description should be considered as exemplary and that of the preferred embodiment only. The true spirit and scope of the present invention should be determined by reference to the appended claims. It is desired to include within the appended claims all modifications that come within the proper scope of the invention.

The embodiments of the invention in which an exclusive property or privilege is claimed are defined as follows:

1. A modularized unit load of rectangular objects comprising:

a plurality of modules of said objects, each of said modules being capable of breaking away from the other modules, each of said breakaway modules comprising a parallel array of objects stacked in side-by-side relationship and approximately centered in a transversely extending plane, said breakaway modules being aligned in end-to-end relationship, each of said breakaway modules being approximately centered on a longitudinally extending axis;

a plurality of severable longitudinally extending braces for interconnecting said modules and forming said unit load; and a plurality of tension bands, at least one of said tension bands surrounding each of said parallel arrays of objects and said braces to secure each of said parallel arrays of objects in modular form to facilitate handling of said objects contained therein, each of said breakaway modules being interconnected by said braces whereby said modules may be selectively removed from said unit load without destroying the structural integrity of said unit load by severing said braces between said modules.

2. The modularized unit load of claim 1 wherein said braces comprise longitudinally extending corner braces.

3. The modularized unit load of claim 1 further including means for selectively longitudinally interconnecting said modules.

4. The modularized unit load of claim 3 wherein said means for selectively longitudinally interconnecting said modules comprises a longitudinally extending pull sheet encompassed by said tension bands.

5. The modularized unit load of claim 3 wherein said means for selectively longitudinally interconnecting said modules comprises a frangible longitudinally extending pallet encompassed by said tension bands.

6. The modularized unit load of claim 5 wherein the unit load includes a plurality of horizontally extending tiers of said objects, said pallet being disposed atop the lowermost of said tiers of said objects.

7. The modularized unit load of claim 5 wherein said pallet comprises:

a bottom layer of sheet material approximately equal in length and width to the length and width of the unit load;

a top layer of sheet material approximately equal in length and width to the length and width of the unit load;

said top and bottom layers of sheet material being divided transversely between modules into a plurality of separate transversely extending strips of sheet material; and a plurality of longitudinally extending frangible stringers secured to said top and bottom layers of sheet material to define one or more apertures to facilitate handling of the unit load.

8. The modularized unit load of claim 7 wherein said stringers are partially cut through transversely between said modules to facilitate breakaway of said modules.

9. The modularized unit load of claim 7 wherein said top and bottom layers comprise first and second sheets of double-faced corrugated paper material.

10. The modularized unit load of claim 7 wherein said top and bottom layers are glued to said stringers.

11. The modularized unit load of claim 5 wherein said pallet includes transversely extending perforations disposed between said modules to facilitate breakaway of each of said modules.

12. The modularized unit load of claim 11 wherein said pallet comprises:

a bottom layer of sheet material approximately equal in length and width to the length and width of the unit load;

a top layer of sheet material approximately equal in length and width to the length and width of the unit load;

said top and bottom layers of sheet material being perforated transversely between modules; and a plurality of discontinuous longitudinally extending stringers secured to said top and bottom layers of sheet material to define two or more apertures to facilitate handling of the unit load, discontinuities in said stringers being transversely aligned to allow transverse as well as longitudinal insertion of forklift tines.

13. The modularized unit load of claim 12 wherein said stringers are partially cut through transversely between said modules to facilitate breakaway of said modules.

14. The modularized unit load of claim 12 wherein said top and bottom layers comprise first and second sheets of double-faced corrugated paper material.

15. The modularized unit load of claim 12 wherein said top and bottom layers are glued to said stringers.

16. A frangible pallet for use in a modularized unit load of rectangular objects comprising:

a transversely extending axis;

a longitudinally extending axis roughly orthogonal to said transversely extending axis;

a bottom layer of sheet material approximately equal in length and width to the length and width of a unit load;

a top layer of sheet material approximately equal in length and width to the length and width of a unit load;

said top and bottom layers of sheet material comprising a plurality of transversely extending strips of sheet material disposed in side-by-side relationship, the interface between adjacent transversely extending strips of sheet material being adapted for disposition between adjacent modules of a unit load; and a plurality of longitudinally extending frangible stringers secured to said top and bottom layers of sheet material to define one or more apertures to facilitate handling of a unit load said stringers being at least partially cut transversely at predetermined positions adapted for disposition between modules of a unit load to facilitate breakaway of modules.

17. The frangible pallet of claim 16 wherein said top and bottom layers comprise first and second sheets of double-faced corrugated paper material.

18. The frangible pallet of claim 16 wherein said top and bottom layers are glued to said stringers.

19. The frangible pallet of claim 16 wherein said top and bottom layers of sheet material are defined by transversely extending perforations extending between modules of the unit load, said perforations dividing said top and bottom layers into a plurality of transversely extending strips of sheet material.

20. The frangible pallet of claim 19 wherein said stringers are discontinuous to provide for transverse as well as longitudinal insertion of forklift tines.

21. The frangible pallet of claim 20 wherein said stringers are partially cut through transversely between said modules to facilitate breakaway of said modules.

22. The frangible pallet of claim 20 wherein said top and bottom layers comprise first and second sheets of double-faced corrugated paper material.

23. The frangible pallet of claim 20 wherein said top and bottom layers are glued to said stringers.

* * * * *